US006688296B1

(12) United States Patent
Greywall

(10) Patent No.: US 6,688,296 B1
(45) Date of Patent: Feb. 10, 2004

(54) ARROW REST

(76) Inventor: Dennis S. Greywall, 9 S. Ryland Rd., Whitehouse Station, NJ (US) 08889

( * ) Notice: Subject to any disclaimer, the term of this patent is extended or adjusted under 35 U.S.C. 154(b) by 0 days.

(21) Appl. No.: 10/225,041

(22) Filed: Aug. 21, 2002

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS 3,244,161 A * 4/1966 Jenson
3,285,237 A * 11/1966 Wolfe
4,907,566 A * 3/1990 Klein
5,205,267 A * 4/1993 Burdick
5,503,136 A 4/1996 Tone
5,553,597 A * 9/1996 Sparks ..... 124/44.5
5,555,875 A * 9/1996 Martin et al. ..... 124/44.5
5,606,961 A 3/1997 Basik et al.
6,082,348 A 7/2000 Savage

* cited by examiner

*Primary Examiner*—John A. Ricci
(74) *Attorney, Agent, or Firm*—Demont & Breyer, LLC

(57) ABSTRACT

An arrow rest for an archery bow includes a shuttle, a cradle and a bow-connecting member. The shuttle, which supports an arrow, is mechanically and magnetically coupled to the cradle. The mechanical coupling enables the shuttle to move through a substantially planar region. The magnetic coupling imparts resilience to the shuttle. The arrow rest is advantageously compliant and resilient in vertical and horizontal directions (i.e., in any direction that is "in-plane" with respect to the substantially planar region in which the shuttle moves). Since resilience is provided by magnetic interaction, wherein the force of attraction decreases with increasing distance, arrow rests in accordance with the illustrative embodiment are advantageously configured to exhibit "fall-away" motion. By adjusting the strength of the magnetic interaction, such as by altering the distance between the materials that are magnetically interacting, the arrow rest can be tailored to an archer's shooting style.

24 Claims, 4 Drawing Sheets

FIG. 4
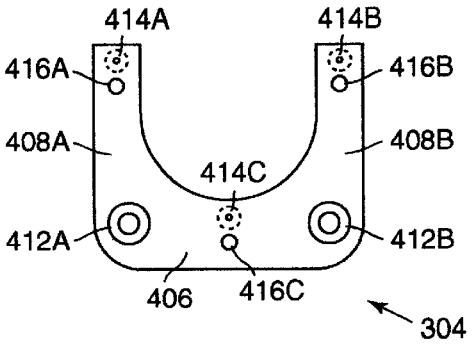
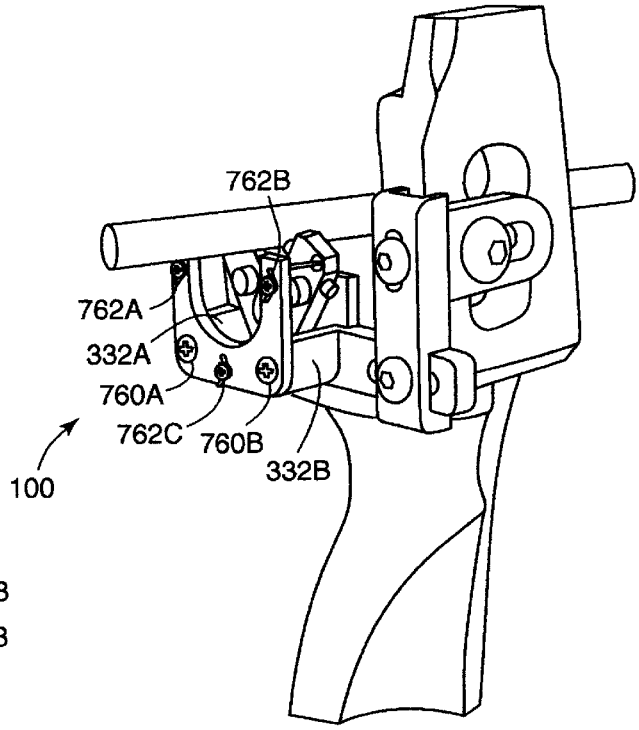
FIG. 7
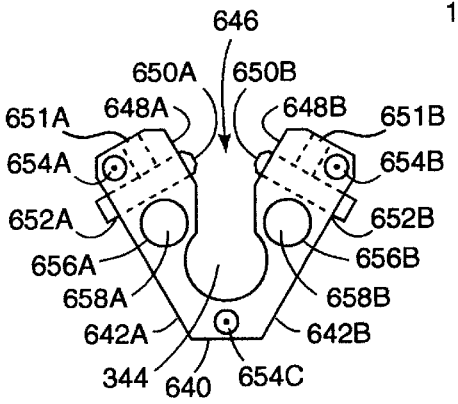
FIG. 6
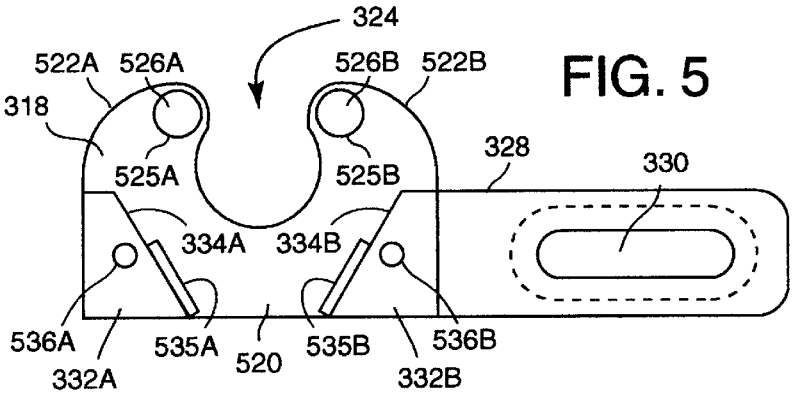
FIG. 5

FIG. 8
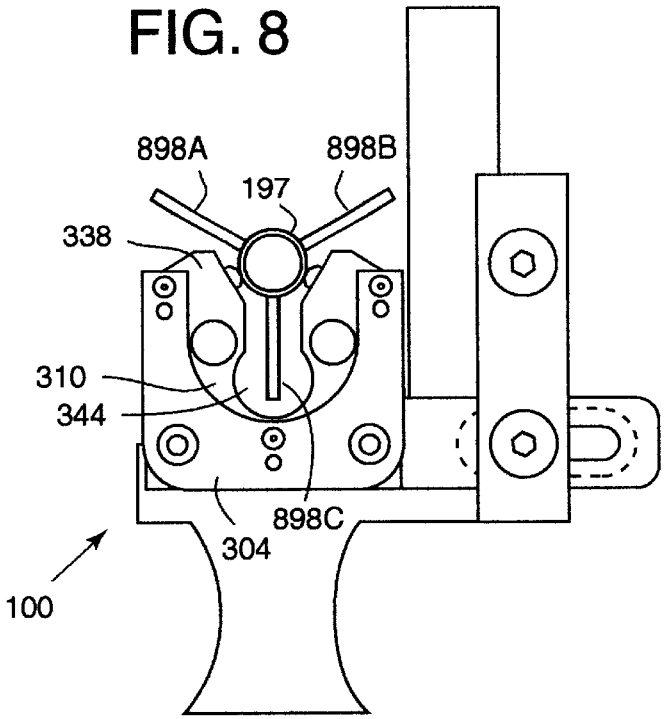
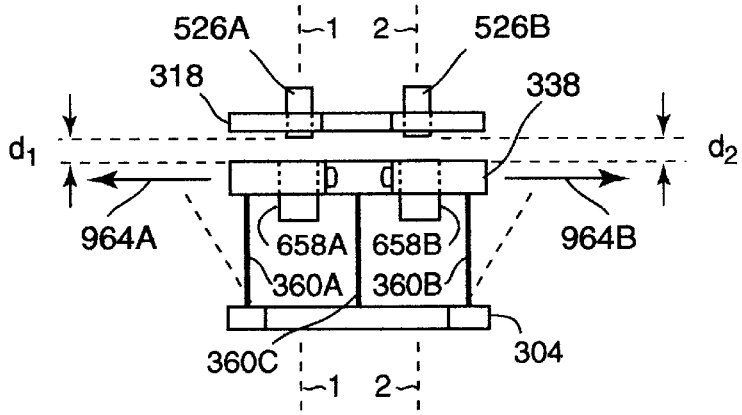
FIG. 9
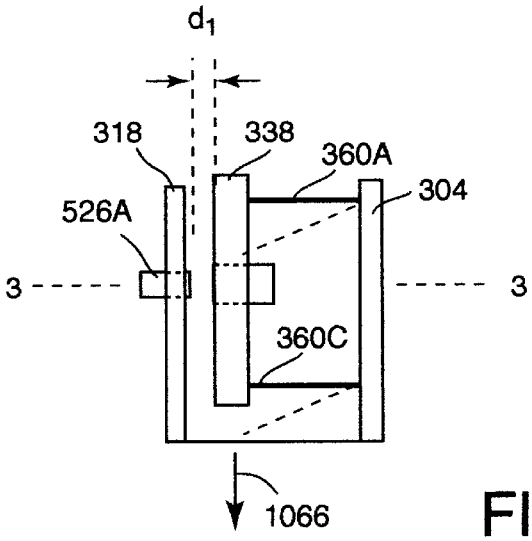
FIG. 10

ARROW REST

FIELD OF THE INVENTION

The present invention relates generally to archery and, more particularly, to an arrow rest for use in conjunction with an archery bow.

BACKGROUND OF THE INVENTION

An arrow rest, which is an add-on device that is located near the midpoint of an archery bow, provides support for a nocked arrow. Ideally, the arrow rest should position the arrow in a reproducible manner and should not impede or otherwise alter its flight following release. But certain events occur during shooting that makes this ideal difficult to attain.

In particular, the flight of an arrow can be altered after release as a result of certain types of contact between it and the arrow rest. For example, forces are imparted to an arrow during release that cause it to flex. These forces are primarily vertically directed for shooters that use a mechanical release aid ("release shooters") and primarily horizontally directed for shooters that do not use a release aid ("finger shooters"). If the arrow rest is not designed to compliantly receive these forces, a flight-altering bounce of the arrow results. Furthermore, contact between the fletchings or vanes of the arrow and the arrow rest affects the arrow's flight. Both of these conditions decrease shooting accuracy.

The art is replete with arrow-rest designs. Many of these designs seek to decrease the deflection of a released arrow to improve shooting accuracy. Notwithstanding any structural differences among these designs, most known arrow rests have certain features in common—features that can limit their effectiveness. Specifically, most known designs incorporate one or more of the following components:

- a pivoting arm to provide compliance;
- bearings for smooth motion of the pivoting arm;
- a mechanical spring to impart resilience to the pivoting arm;
- a stop to limit travel of the pivoting arm.

In most arrow rests that have a movable arm, the arm pivots about an axis. One disadvantage of pivoting arms is that they typically are compliant (i.e., provide for movement) in only one direction—usually the vertical direction (i.e., movement in a plane that is parallel to the handle-riser portion of the bow), as they pivot about a horizontal axis. This limits the desirability of the arrow rest for finger shooters, who tend to impart forces that require compliance in the horizontal direction. In fact, it is generally understood that both finger and release shooters would benefit from an arrow rest that is compliant in two directions: vertical and horizontal.

Pivoting arms typically use bearings (e.g., ball, sleeve, etc.) to provide smooth motion. But a disadvantage of bearings is that they introduce "play" into the arm, often as much as $1/16^{th}$ of an inch, thereby decreasing shooting accuracy.

A disadvantage of a mechanical spring, which is often used to impart resilience (i.e., elastic behavior) to the pivoting arm, is that it exhibits "hysteresis." That is, as the spring ages, its behavior (i.e., the spring constant) changes, so that the spring might not be able to return the pivoting arm to its original position. Failure to position the arrow shaft in a reproducible manner can affect shooting accuracy.

A further disadvantage of a mechanical spring for this use is that it has a restoring force that increases with increasing displacement. Due to this characteristic, as a pivoting arm that is biased by a mechanical spring moves relatively further from its rest position (i.e., in reaction to a relatively greater force imparted by the arrow), a relatively greater restoring force is experienced. In contrast, it is generally accepted that a fall-away motion, wherein the restoring force decreases with increasing displacement, is preferable.

Another disadvantage of a mechanical spring for this use is that it typically requires the use of a "stop." After the movable arm has pivoted downward in response to an impulse from an arrow, the arm is accelerated back (toward its rest position) due to the action of the mechanical spring (i.e., resilience). The stop abruptly settles (i.e., stops) the arm at its rest position. The abrupt fashion in which the arm is stopped can introduce noise, which is anathema to a bow hunter.

So, despite the large number of arrow rests that are available, most exhibit one or more disadvantages as described above. A need therefore remains for an arrow rest that overcomes or at least ameliorates one or more of the foregoing shortcomings toward the end of achieving the ideal of reproducible arrow positioning and true flight.

SUMMARY OF THE INVENTION

In accordance with the present invention, an arrow rest is disclosed that avoids at least some of the disadvantages of known arrow rests. Some arrow rests in accordance with the illustrative embodiment of the invention:

- do not include an arm that pivots about an axis;
- do not use bearings;
- do not use a mechanical spring; and
- do not use a stop.

Some arrow rests in accordance with the illustrative embodiment include a shuttle, a cradle and a bow-connecting member. The shuttle, which supports a nocked arrow, is mechanically and magnetically coupled to the cradle. The cradle, in turn, is connected to an archery bow by the bow-connecting member.

The shuttle is mechanically coupled to the cradle in such a way that the shuttle has some freedom to move or "glide" in two dimensions that are generally orthogonal to the axis of the arrow.

The magnetic coupling between the shuttle and the cradle imparts resilience to the shuttle. Arrow rests in accordance with the illustrative embodiment are advantageously resilient vertically and horizontally in a plane. Furthermore, since resilience is provided by magnetic interaction, wherein the force of attraction decreases with increasing distance, arrow rests in accordance with the illustrative embodiment are advantageously configured to exhibit "fall-away" motion. By adjusting the strength of the magnetic interaction, such as by altering the distance between the materials that are magnetically interacting, the arrow rest can be tailored to an archer's shooting style.

The illustrative embodiment described above, and some variations thereof, are illustrated in the Drawings and described further in the Detailed Description section of this specification.

BRIEF DESCRIPTION OF THE DRAWINGS

FIG. 4 depicts a front plate of the arrow rest shown in FIG. 3.

FIG. 5 depicts a back plate and a bow-connecting member of the arrow rest shown in FIG. 3.

FIG. 6 depicts a shuttle of the arrow rest shown in FIG. 3.

FIG. 7 depicts the arrow rest as shown in FIG. 1.

FIG. 8 depicts a front view of the arrow rest of FIG. 1.

FIG. 9 depicts a top view of the arrow rest of FIG. 1 with some features omitted for clarity.

FIG. 10 depicts a side view of the arrow rest of FIG. 1 with some features omitted for clarity.

DETAILED DESCRIPTION

The terms listed below are defined for use in this Description and the appended claims as follows:

Compliance (noun) or Compliant (adjective) means the tendency to yield (e.g., move, etc.) in response to an applied force.

Coupled means an interaction between elements. For example, elements can be mechanically coupled. Mechanically-coupled elements are directly or indirectly connected to one another. The interaction can be strictly one of physical connection (e.g., a first element bolted to a second element). Alternatively, the interaction can be a transfer of a force. For example, if a first element is mechanically coupled to a second element via a linkage, movement of the first element might cause the second element to move. Furthermore, elements can be magnetically (or more generally, electromagnetically) coupled. Magnetically-coupled elements both interact with a magnetic field that is generated by one or more of the (magnetically-coupled) elements, or by an external instrumentality.

Horizontal means a direction that is orthogonal to the riser portion of the bow and orthogonal to a nocked arrow (e.g., arrow 197, see FIG. 1) when the bow is in shooting position. Also, "horizontal" means aligned with "left" and "right" in the Figures (e.g., see FIG. 9).

Magnet is defined as an object that is surrounded by a magnetic field and that has the property, either natural or induced, of attracting iron or steel.

Magnetic material is defined as:

i. a material having the properties of a magnet; or ii. a material that is capable of being magnetized; or iii. a material that is capable of being attracted by a magnet; or iv. any combinations of i, ii, and iii.

Resilience (noun) or Resilient (adjective) means the property or ability to return to an original position.

Vertical means a direction aligned with the riser portion of the bow (i.e., riser 196, see FIG. 1) when the bow is in shooting position and orthogonal to a nocked arrow. Also, "vertical" means aligned with "up" and "down" in the Figures (e.g., FIG. 1).

Additional terms are defined later in this Description.

Figure 1:
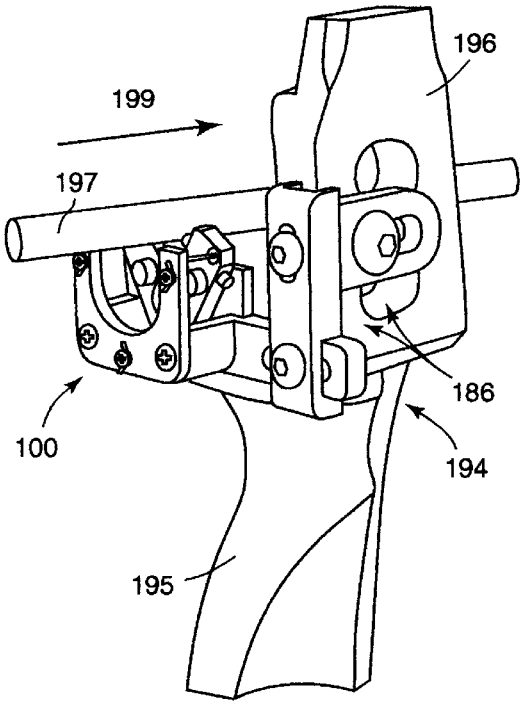
FIG. 1 depicts a perspective view of an arrow rest in accordance with the illustrative embodiment of the present invention.

FIG. 1 depicts arrow rest 100 in accordance with the illustrative embodiment of the present invention. Arrow rest 100 supports nocked arrow 197 (depicted in partial section for clarity), which, on release, flies in direction 199. In use, arrow rest 100 is connected to handle-riser portion 194 of an archery bow (handle 195 and riser 196) by bow-mounting arrangement 186. By way of context, arrow rest 100 is shown connected to a "right-handed" bow (i.e., a bow that is used by an archer that is shooting in a classic right-handed style with the left hand gripping handle 195 and the right hand drawing back the bow string).

Figure 3:
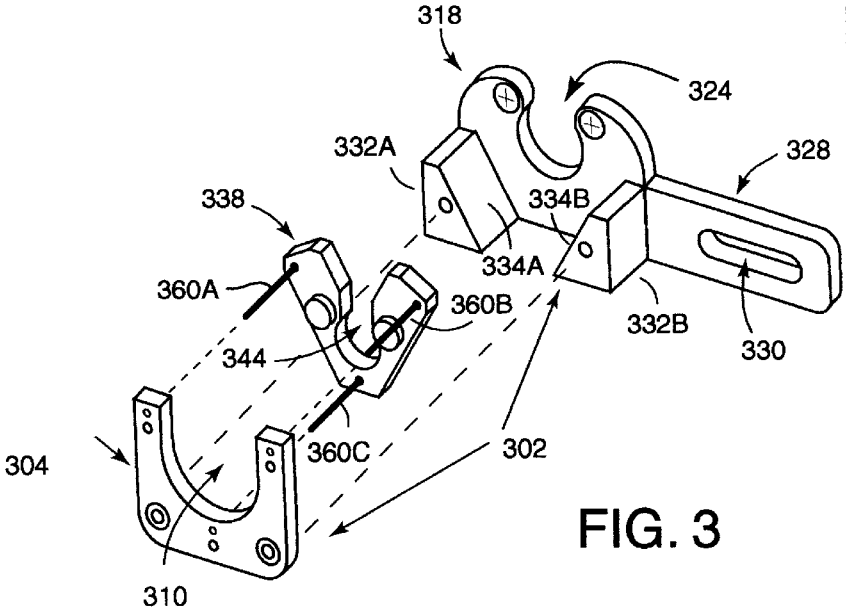
FIG. 3 depicts an exploded view of the arrow rest shown in FIG. 1.

With reference to the illustrative embodiment depicted in FIG. 3, arrow rest 100 includes front plate 304, shuttle 338, spacers 332A and 332B, back plate 318 and bow-connecting member 328. These elements are formed from one or more materials that are advantageously lightweight and non-magnetic. Suitable materials include, without limitation, plastic and appropriate metals, such as aluminum. In embodiments in which the material of construction is metal, then the various elements of arrow rest 100 are typically machined to obtain a desired final configuration and shape. In embodiments in which the material of construction is plastic, then the various elements of arrow rest 100 are typically injection molded.

Front plate 304, spacers 332A and 332B, and back plate 318, which are coupled to one another, define cradle 302. Shuttle 338 is advantageously mechanically coupled and magnetically coupled to cradle 302 (at different locations). In accordance with the illustrative embodiment, the mechanical coupling is implemented in such a way that the shuttle is movable or compliant through an approximately planar region that is parallel to front plate 304 and back plate 318. In other words, shuttle 338 has two degrees of freedom of movement, whereas most known pivoting arrow rests have only one degree of freedom.

Furthermore, magnetic coupling is implemented in such a way as to impart resilience to shuttle 338. And, in at least some embodiments, the magnetic coupling between shuttle 338 and cradle 302 provides "fall-away" motion, wherein the further shuttle 338 moves from a rest position, the weaker is the restoring force urging it back.

The various elements and attributes of arrow rest 100 are now described in further detail.

Figure 2:
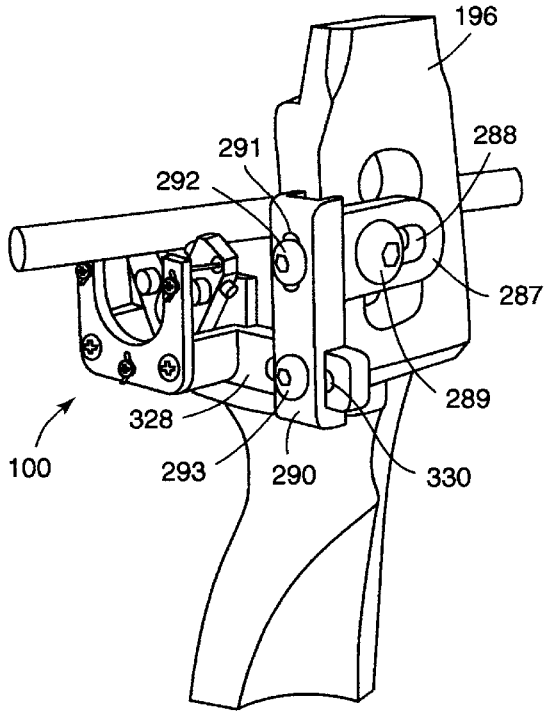
FIG. 2 depicts the arrow rest as shown in FIG. 1.

With reference to FIG. 2, bow-connecting member 328 and bow-mounting arrangement 186 couple cradle 302 to an archery bow. Bow-mounting arrangement includes side plate 287 and riser clamp 290. Side plate 287 is attached to riser 196 by threaded fastener 289 (e.g., bolt, screw, etc.). The fastener passes through slot 288 in side plate 287 and is received by a threaded hole (not shown) in riser 196. Riser clamp 290 attaches to both side plate 287 and bow-connecting member 328 of arrow rest 100. In particular, threaded fastener 292 passes through slot 291 in riser clamp 290 and is received by a threaded hole (not shown) at the end of side plate 287. Likewise, threaded fastener 293 passes through a hole (not shown) in riser clamp 290 and through slot 330 in bow-connecting member 328. A nut (not shown) located behind bow-connecting member 328 receives fastener 293 thereby connecting arrow rest 100 to riser clamp 290. Slot 288 (in side plate 287), slot 291 (in riser clamp 290), and slot 330 (in bow-connecting member 328) each have a generally oblong shape. Elements that possess these slots can be adjustably positioned (over the length of the slot). Collectively, these three slots provide the ability to adjustably position arrow rest 100 in three dimensions.

Those skilled in the art will understand that a wide variety of configurations for mechanically coupling an arrow rest to a bow, as are known in the art, can suitably be used to couple arrow rest 100 to an archery bow.

Referring now to FIGS. 3 through 7, in the illustrative embodiment, spacers 332A and 332B and bow-connecting member 328 are integrally attached to back plate 318 (i.e., they are formed together as a unitary piece). Front plate 304 attaches to spacers 332A and 332B via threaded fasteners 760A and 760B. In the illustrative embodiment, these threaded fasteners pass through respective holes 412A and 412B in front plate 304 and are received by respective threaded openings 536A and 536B in spacers 332A and 332B. In some variations of arrow rest 100, spacers 332A and 332B and bow-connecting member 328 are not integrally attached to back plate 318. Those skilled in the art will recognize that it is a simply a matter of engineering choice or expediency as to which, if any, of the various elements of arrow rest 100 are integrally formed.

Shuttle 338 is disposed between front plate 304 and back plate 318 and between opposed angled surfaces 334A and 334B of respective spacers 332A and 332B. Shuttle 338 is coupled to front plate 304 by three movable arms 360A, 360B, and 360C (collectively "arms 360"). Three arms are advantageously used because it is the minimum number required for stabilizing shuttle 338 in the illustrative configuration.

Arrow-receiving region 646 is defined between inner angled surfaces 648A and 648B of respective sides 642A and 642B of shuttle 338. As its name implies, arrow-receiving region 646 supports a nocked arrow. In the illustrative embodiment, arrow-receiving region 646 includes arrow supports 650A and 650B, which are received by openings 652A and 652B in respective sides 642A and 642B of shuttle 338. Openings 651A and 651B each receive a set-screw (not shown), which is used to keep arrow supports 650A and 650B in place, as necessary. Arrow supports 650A and 650B advantageously possess a relatively low-friction surface so as not to impede the arrow's release, and are advantageously non-magnetic. For example, in some embodiments, arrow supports 650A and 650B are formed of Teflon®. In some other embodiments, arrow supports 650A and 650B are stainless-steel ball bearings. Those skilled in the art will know how to make and use arrow supports 650A and 650B.

An open region is defined between upright sides 408A and 408B of front plate 304 (i.e., region 310), between upright sides 642A and 642B of shuttle 338 (i.e., region 344) and between upright sides 522A and 522B of back plate 318 (i.e., region 324). Regions 310, 344, and 324 align so that, upon release of arrow 197, there is no contact between arrow rest 100 and the one downward-facing fletching or vane 898C (see, e.g., FIG. 8).

As previously indicated, shuttle 338 is coupled to front face 304 of cradle 302 via three arms 360. In the illustrative embodiment, arms 360 are realized as short sections of nylon line, one for each of the three pairs of aligned openings in front plate 304 and in shuttle 338. In particular, arm 360A passes through hole 414A in front plate 304 and opening 654A in shuttle 338. Likewise arm 360B passes through paired, aligned openings 414B and 654B, and arm 360C passes through paired, aligned openings 414C and 654C. An enlarged region (not shown) at the shuttle end of each of arms 360 keeps shuttle 338 engaged to the arms. The other end of each arm 360 is secured, for example, by wrapping it around respective threaded fasteners 762A, 762B, and 762C, which engage respective threaded openings 416A, 416B, and 416C in front plate 304.

Arms 360 advantageously do not exhibit resilience, elasticity, or otherwise deform. In other words, arms 360 are advantageously (but not necessarily) substantially free of a "memory" characteristic. Consequently, there is a general preference for stranded over non-stranded materials and a preference for non-rigid over rigid materials, as the former item of each pair is expected to exhibit less of a memory characteristic than the latter item. Suitable materials includes wire, natural or synthetic filaments or fibers, or assemblages of filaments or fibers (e.g., into cords, line, cable, etc.). The filaments or fibers can be formed from various synthetic or natural polymeric substances (e.g., polyamide [nylon], polypropylene, polyacrylonitrile, polyester, cellulosic polymers, etc.). The wire can be formed from non-magnetic metals (e.g., stainless steel, etc.). In some preferred embodiments, arms 360 comprise stranded nylon line, and in some additional preferred embodiments, arms 360 comprise stranded stainless steel wire. The diameter of the line or wire is quite small, typically in a range of about 6 mil to 20 mil (1 mil equals 1/1000 of an inch). Stranded line and wire is commercially available from Sava Industries, Inc. of Riverdale, N.J., among others.

When arms 360 are formed from stranded material, the enlarged region at one end of the arms (for keeping shuttle 338 engaged to arms 360) can be formed by removing (from the end of the arm) the cover material (e.g., teflon, etc.) that keeps the strands together. This causes the individual strands to separate and "flare out" at that end. The flared strands can then be treated with epoxy to fix them in this flared condition, creating the enlarged nub that prevents shuttle 338 from slipping off the ends of arms 360.

Referring now to FIGS. 5, 6 and 9 through 12, two small but high-field-strength magnets 658A and 658B are disposed in respective openings 656A and 656B in shuttle 338. In some embodiments, the magnets are glued into the openings. Also, two "plugs" 526A and 526B (e.g., set-screws, etc.) that are made from a magnetic material are disposed in respective openings 525A and 525B in back plate 318. Magnet 658A aligns with magnetic plug 526A and magnet 658B aligns with plug 526B. Each paired magnet and plug are close enough to one another to experience a strong interaction (e.g., magnetic attraction).

In the context of the illustrative embodiment, the phrase "strong interaction" means an attraction that places arms 360 in tension such that shuttle 338 "floats" within cradle 302, but has no tendency to move unless urged into movement by external forces, such as forces that are generated upon the release of a nocked arrow. The distance between each paired magnet and magnetic plug (i.e., distance $d_1$ between magnet 658A and plug 526A and distance $d_2$ between magnet 658B and plug 526B) is typically in a range of about 20–50 mil, as a function of magnet strength.

It is notable that distances $d_1$ and $d_2$ are individually and infinitely adjustable. As a practical matter, these distances are advantageously adjusted (e.g., by simply turning the plug [e.g., set screw] to move it further or closer to the magnet, etc.) to suit an archer's shooting style.

Figure 11:
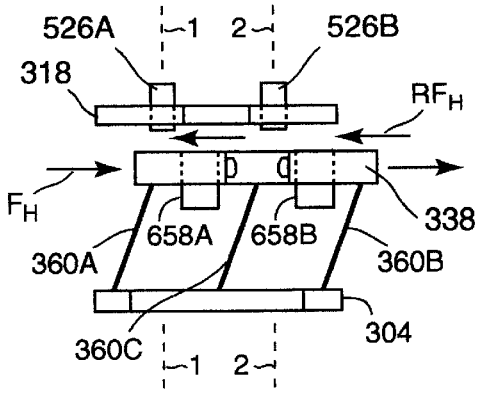
FIG. 11 depicts the arrow rest shown in FIG. 9 wherein the shuttle has moved in response to the release of an arrow.
Figure 12:
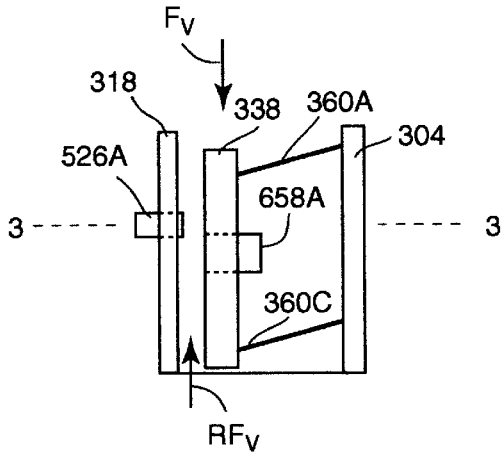
FIG. 12 depicts the arrow rest shown in FIG. 10 wherein the shuttle has moved in response to the release of an arrow.

FIGS. 9 through 12 depict simplified representations of arrow rest 100, omitting certain features (e.g., spacers 332A and 332B, etc.) and exaggerating certain spatial relationships (e.g., the distances $d_1$ and $d_2$ between the magnets and plugs) for the sake of clarity. These Figures illustrate the manner in which the magnetic coupling between shuttle 338 and cradle 302, as effected by the magnets and plugs, imparts resilience to shuttle 338. In particular, FIGS. 9 and 11 illustrate "horizontal" resilience and FIGS. 10 and 12 illustrate "vertical" resilience.

FIGS. 9 and 11 depict a top view of arrow rest 100. Visible in FIGS. 9 and 11 are back plate 318, shuttle 338, and front plate 304. Arms 360A, 360B, and 360C are shown coupling shuttle 338 to front plate 304. As depicted in FIG. 9, in a zero or undisturbed position, magnet 658A and plug 526A, which exhibit a magnetic interaction, align with axis 1-1 and magnet 658B and plug 526B, which also exhibit a magnetic interaction, align with axis 2-2. When a nocked arrow is released, forces that are imparted to the arrow cause it to flex. As the arrow rebounds, these forces couple to shuttle 338. To the extent that these forces include horizontal components, shuttle 338 will be urged away from its zero position either to the "left" in direction 964A or to the "right" in direction 964B, since shuttle 338 is compliant in the horizontal direction.

FIG. 11 depicts shuttle 338 after it has moved to the "right" (i.e., direction 964B) due to a force $F_H$ that was imparted by an arrow on release. As shown in FIG. 11, arms 360 swing to the "right" to enable this movement. Although the distance between each magnet—plug pair has now increased, a significant magnetic attraction between these elements remains. In fact, the remaining magnetic attraction is sufficient to draw shuttle 338 back to its zero position. In this manner, the magnetic field between each magnet—plug pair provides a "restoring force" $RF_H$ that re-centers shuttle 338. This restoring force—the magnetic field—provides a resilience to shuttle 338.

Depending upon the magnetic field strength between each paired magnet and magnetic plug, and the magnitude and direction of the forces coupled to shuttle 338, the shuttle might move far enough that it contacts spacers 332A or 332B. To substantially muffle any sound from being caused by this contact, thin pads 535A and 535B (made from felt, etc.) are disposed on respective angled surfaces 334A and 334B of respective spacers 332A and 332B.

FIGS. 10 and 12 depict a left-side view of arrow rest 100. Visible in these Figures are back plate 318, shuttle 338, and front plate 304. Arms 360A and 360C are shown (arm 360B is obscured by arm 360A) coupling shuttle 338 to front plate 304. To the extent that a released arrow imparts "vertical" components of force to shuttle 338, the shuttle will be urged away from its zero position (aligning with axis 3-3) in "downward" direction 1066, since shuttle 338 is compliant in the vertical direction. While shuttle 338 is free to move in an "upward" direction, it is unlikely that any forces imparted by a released arrow would cause the shuttle to move upward.

FIG. 12 depicts shuttle 338 after it has moved downward (i.e., direction 1066) due to a force $F_v$ that was imparted by an arrow on release. As shown in FIG. 12, arms 360 swing downward to enable this movement. The remaining magnetic attraction between each magnet—plug pair functions as a restoring force $RF_v$, which is sufficient to draw shuttle 338 back to its zero position (i.e., aligned with axis 3-3).

Figure 13:
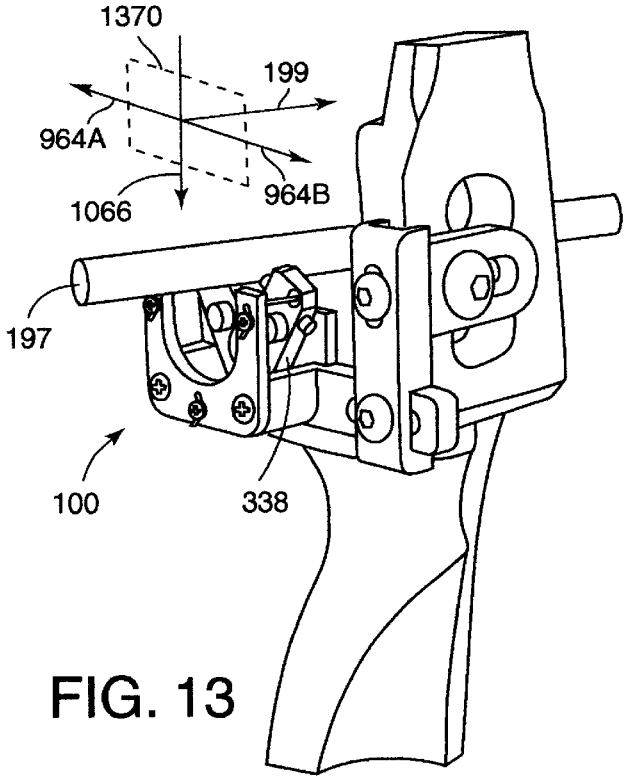
FIG. 13 depicts the arrow rest shown in FIG. 1.

It will be appreciated that shuttle 338 does not merely move "left" or "right" or "down;" these are simply the vector components of its motion. That is, shuttle 338 is free to move in any direction through what is "conveniently" (but not strictly accurately) represented in FIG. 13 as plane 1370. It will be understood that, in the strictest sense, the movement of shuttle 338 is not truly planar. In particular, as shuttle 338 moves in any direction away from its zero position, the gap between the shuttle and front plate 304 decreases. The further the distance from the zero position, the smaller that gap. Consequently, the movement of shuttle 338 away from its zero position actually defines a curved surface. The term "substantially planar" is defined for use in this Description and the appended Claims to characterize this pseudo-planar movement of shuttle 338. It is noted, however, that shuttle 338 remains parallel to front plate 304 and back plate 318 and orthogonal to arrow 197 and orthogonal to the arrow's direction of flight 199.

As shuttle 338 moves increasingly further from its zero position (either horizontally or vertically), the restoring force (i.e., the tendency for the shuttle to return to its zero position) decreases. This occurs because magnetic-field strength decreases as the distance between magnets 658A and 658B and respective plugs 526A and 526B increases. Due to this characteristic decrease in field strength, shuttle 338 exhibits "fall-away" motion, as is generally desirable. It is notable that this behavior is opposite to the behavior that is exhibited by a mechanical spring, which exhibits an increasing restoring force as it is stretched.

Magnets 658A and 658B are advantageously materials that exhibit a relatively high magnetic field strength for their weight, such as, without limitation, rare-earth magnets. Rare-earth magnets include, for example, neodymium iron boron (NdFeB) and samarium cobalt (SmCo). Rare-earth magnets are commercially available from Dexter Magnetic Technologies, Inc. of Hicksville, N.Y., among others. Magnetic materials suitable for use as plugs 526A and 526B include, without limitation, magnetic iron, cobalt, nickel, and the like.

The various elements of arrow rest 100 are advantageously made to be as small as possible, consistent with the diameter of an arrow, the size of its fletchings or vanes, and consistent with providing enough space to accommodate the various features that are incorporated into each element. Illustrative dimensions for various elements of arrow rest 100 are provided below:

| | |
|---|---|
| For front plate 304: | |
| overall width | 36.5 mm |
| overall height | 30.8 mm |
| depth of opening 310 | 21.4 mm |
| For shuttle 338: | |
| width at top | 34.9 mm |
| width of arrow receiving region (upper) | 16.7 mm |
| width of arrow receiving region (lower) | 7.9 mm |
| depth of opening 344 (from bottom of arrow supports 650A, 650B) | 18.3 mm |
| overall height | 28.6 mm |
| width at bottom | 9.4 mm |
| For spacers 332A, 332B: | |
| overall height | 12.7 mm |
| thickness | 15.9 mm |
| opening between spacers (at top) | 28.6 mm |
| opening between spacers (at bottom) | 12.7 mm |
| For back plate 318: | |
| overall width | 36.5 mm |
| overall height | 23.8 mm |
| depth of opening 324 | 14.2 mm |

It is understood that while in the illustrative embodiment, magnets 658A and 658B are on shuttle 338 and plugs 526A and 536B are on back plate 318, in some variations, this arrangement is reversed. Furthermore, in some other variations, magnets, with attracting poles facing one another, are disposed on both shuttle 338 and back plate 318. The magnet-plug pair of the illustrative embodiment is therefore more generally described, and is but one example of, a "means for magnetically attracting." "Means for magnetically attracting" is defined for use in this Description and the appended claims as an arrangement, element(s), etc., that incorporates magnetic material.

Likewise, it will be understood that the illustrative arrangement of paired magnets and plugs is one example of a "means for electromagnetic resilience." "Means for imparting electromagnetic resilience" is defined for use in this Description and the appended claims as an arrangement, element(s), etc., that:

1. directly or indirectly causes an electromagnetic interaction involving the portion of the arrow rest that is movable (e.g., shuttle, etc.); and
2. is positioned or otherwise implemented so that the electromagnetic interaction involving the movable portion of the arrow rest provides a restoring force to counter its (the movable portion) motion, such as might be caused by the release of an arrow.

In some variations of the illustrative embodiment, arrow rest 100 has a "means for confining an electromagnetic field." As defined in this Description and the appended claims, "means for confining an electromagnetic field" is an arrangement, element, etc., that is capable of confining the electromagnetic field (e.g., magnetic field, etc) that is generated by:

1. the magnetic material that is disposed at shuttle 338 or back plate 318 or both;
2. the means for magnetically attracting; or
3. the means for imparting electromagnetic resilience.

Figure 14:
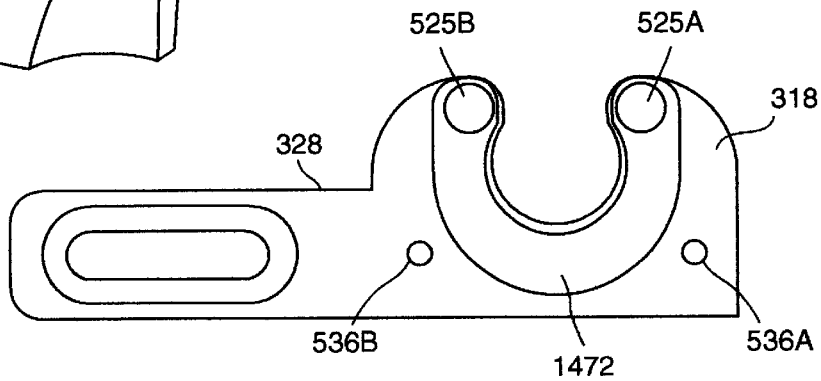
FIG. 14 depicts a back view of the back plate and bow-connecting member shown in FIG. 5.

An example of a means for confining an electromagnetic field is depicted in FIG. 14.

FIG. 14 depicts a back view of back plate 318 of arrow rest 100 wherein optional member 1472 couples plugs 526A and 526B. Member 1472, which is formed from a material that is capable of being attracted by a magnet (e.g., iron, etc.), confines the magnetic field that is generated by magnets 658A and 658B. That is, the magnetic field that would otherwise project from the back of plugs 526A and 526B is drawn into member 1472. This reduces, to inconsequential levels, the intensity of any magnetic interaction that might otherwise occur between the magnets and a steel tip (not shown) that is often attached to the front end of an arrow. In embodiments in which member 1472 is used, the north pole of one of the magnets (e.g., magnet 658A, etc.) should face back plate 318 while the south pole of the other magnet (e.g., magnet 658B, etc.) should face back plate 318.

The arrangement of arms 360 by which shuttle 338 is coupled connected to cradle 302, and by which compliance is imparted to the shuttle, is one example of a "means for non-pivoting motion." "Means for non-pivoting motion" is defined as an arrangement or element(s) that:

1. mechanically couples the part of the arrow rest that supports an arrow to a non-moving part of the arrow rest;
2. enables the part of the arrow rest that supports an arrow to move; and
3. enables the part of the arrow rest that moves to move in non-pivotal (does not pivot about an axis) motion.

In some embodiments, means for non-pivoting motion enables movement in two directions, while most pivoting arrangements enable motion in only one direction. It is noteworthy that the motion of each arm 360, individually, can be described as rotating or pivoting. But the movable portion of the arrow rest (shuttle 338 in the illustrative embodiment) does not pivot or rotate about a point or axis. In other words, the descriptor "non-pivoting" refers to the moving portion of the arrow rest (e.g., shuttle 338) not arms 360.

It is to be understood that the above-described embodiments are merely illustrative of the present invention and that many variations of the above-described embodiments can be devised by those skilled in the art without departing from the scope of the invention. It is therefore intended that such variations be included within the scope of the following claims and their equivalents.

I claim:

1. An article comprising an arrow rest, said arrow rest comprising:

a cradle having a front face and a back face, wherein said front face and said back face are spaced apart from one another; and a shuttle having an arrow-support region for receiving an arrow shaft, wherein said shuttle is mechanically and movably coupled to said front face of said cradle, and wherein said shuttle is magnetically attracted toward said back face of said cradle.

2. The article of claim 1 further comprising a plurality of arms, wherein:

said arms mechanically and movably couple said shuttle to said front face of said cradle; and said arms are substantially free of a memory characteristic.

3. The article of claim 2 wherein said arms are selected from the group consisting of wire, fibers, filaments, assemblages of filaments, and assemblages of fibers.

4. The article of claim 2 further comprising:

a magnet, wherein said magnet depends from said shuttle;

a plug of magnetic material, wherein said plug depends from said back face of said cradle; and a gap, wherein said gap separates said magnet from said plug.

5. The article of claim 1 wherein said arrow-support region of said shuttle comprises at least two arrow supports, wherein said arrow supports have a low-friction surface.

6. The article of claim 1 further comprising a bow-connecting member, wherein said bow-connecting member depends from said back plate of said cradle.

7. The article of claim 6 further comprising an archery bow, wherein said arrow rest is attached to said archery bow via said bow-connecting member.

8. An article comprising an arrow rest, said arrow rest comprising:

a shuttle having an arrow-support region for receiving an arrow shaft;

a cradle that receives said shuttle;

means for non-pivoting motion by which said shuttle is movably coupled to said cradle;

and means for imparting electromagnetically-induced resilience to said shuttle.

9. The article of claim 8 wherein said means for imparting electromagnetically-induced resilience further comprises means for magnetically attracting said shuttle to said cradle.

10. The article of claim 8 wherein said means for non-pivoting motion enables said shuttle to move in a substantially planar region.

11. The article of claim 10 wherein said means for imparting electromagnetically-induced resilence imparts resilience to said shuttle in both vertical and horizontal directions.

12. An article comprising an arrow rest, said arrow rest comprising:

a cradle having a front face and a back face, wherein:

said front face and said back face are spaced apart from one another; and said back face comprises magnetic material;

a shuttle having an arrow-support region for receiving an arrow shaft, wherein:

said shuttle is movably coupled to said front face of said cradle; and said shuttle comprises magnetic material.

13. The article of claim 12 further comprising a plurality of arms wherein said arms connect said shuttle to said front face of said cradle in such a way as to:

substantially restrict said shuttle from moving toward said back plate of said cradle; and not restrict said shuttle from moving along a first axis and a second axis, wherein said first axis and said second axis are orthogonal to one another.

14. The article of claim 13 wherein said first axis is horizontal and said second axis is vertical.

15. The article of claim 12 wherein a magnetic field emanates from at least one of either said magnetic material at said back face or said magnetic material at said shuttle, and further comprising means for confining an electromagnetic field.

16. An article comprising an arrow rest, said arrow rest comprising:

a movable part, wherein said movable part has an arrow-support region for receiving an arrow shaft;

a non-moving part; and means for non-pivoting motion that couples said movable part to said non-moving part, wherein said means for non-pivoting motion enables said movable part to move with at least two degrees of freedom.

17. The article of claim 16 further comprising means for imparting electromagnetically-induced resilience to said movable part.

18. The article of claim 17 wherein said means for imparting electromagnetically-induced resilience comprises means for magnetically attracting said movable part to said non-moving part.

19. The article of claim 16 wherein said means for non-pivoting motion enables said movable part to move through a substantially planar region.

20. An article comprising an arrow rest, said arrow rest comprising:

a shuttle having an arrow-support region for receiving an arrow shaft; and means for non-pivoting motion that movably couples said shuttle to a non-moving part of said arrow rest, wherein said means for non-pivoting motion does not include a bearing, and wherein said means for non-pivoting motion enables said shuttle to move with at least two degrees of freedom.

21. The article of claim 20 further comprising means for imparting electromagnetically-induced resilience to said shuttle, wherein said means for imparting electromagnetically-induced resilience does not include a mechanical spring.

22. An article comprising an arrow rest, said arrow rest comprising:

a movable part, wherein said movable part has an arrow-support region for receiving an arrow shaft;

means for imparting electromagnetically-induced resilience to said movable part;

a non-moving part; and means for non-pivoting motion that couples said movable part to said non-moving part.

23. The article of claim 22 wherein said means for imparting electromagnetically-induced resilience comprises means for magnetically attracting said movable part to said non-moving part.

24. The article of claim 22 wherein said means for non-pivoting motion enables said movable part to move through a substantially planar region.

* * * * *